US008474925B2

(12) United States Patent
Koenig et al.

(10) Patent No.: US 8,474,925 B2
(45) **Date of Patent: *Jul. 2, 2013**

(54) LOCKABLE EJECTOR DEVICE FOR A FURNITURE PART MOVABLY SUPPORTED IN PIECE OF FURNITURE

(75) Inventors: Bernd Koenig, Höch (AT); Martin During, Schruns (AT)

(73) Assignee: Julius Blum GmbH, Hochst (AT)

( * ) Notice: Subject to any disclaimer, the term of this patent is extended or adjusted under 35 U.S.C. 154(b) by 38 days.

This patent is subject to a terminal disclaimer.

(21) Appl. No.: 12/873,502

(22) Filed: Sep. 1, 2010

(65) Prior Publication Data

US 2010/0320888 A1 Dec. 23, 2010

Related U.S. Application Data

(63) Continuation of application No. PCT/AT2009/000101, filed on Mar. 13, 2009.

(30) Foreign Application Priority Data

Mar. 19, 2008 (AT) ..... A 437/2008

(51) Int. Cl.
*A47B 95/00* (2006.01)
*A47B 88/00* (2006.01)

(52) U.S. Cl.
USPC ..... 312/333

(58) Field of Classification Search
USPC ..... 312/333; 292/194, 214, 229, 195, 292/203
See application file for complete search history.

(56) References Cited

U.S. PATENT DOCUMENTS

| | | | | |
|---|---|---|---|---|
| 69,068 | A * | 9/1867 | Brada | 312/334.27 |
| 78,449 | A * | 6/1868 | Gibbs | 70/120 |
| 2,271,431 | A * | 1/1942 | Hauser et al. | 312/333 |
| 2,343,977 | A * | 3/1944 | Jones et al. | 292/5 |

(Continued)

FOREIGN PATENT DOCUMENTS

| | | |
|---|---|---|
| AT | 8882 | 2/2007 |
| DE | 20 2006 012 347 | 1/2008 |

(Continued)

OTHER PUBLICATIONS

International Search Report issued Oct. 21, 2009 in International (PCT) Application No. PCT/AT2009/000101.

(Continued)

*Primary Examiner* — Janet M Wilkens
*Assistant Examiner* — Timothy M Ayres
(74) *Attorney, Agent, or Firm* — Wenderoth, Lind & Ponack, L.L.P.

(57) ABSTRACT

The invention relates to a lockable ejector device for a furniture part that is movably supported in a piece of furniture, including a fixing device for locking the movable furniture part in place in a closed end position, and at least one ejector element for moving the movable furniture part from the closed end position into an open position, wherein the fixing device comprises at least two locking units, which are coupled to each other and each have a receiving element for an engagement element. The at least two locking units are operatively connected to each other by way of a synchronization mechanism, which has at least two coupling elements, each associated with different locking units, and at least one synchronization unit. The coupling elements are coupled by way of the synchronization unit with respect to the movements thereof.

27 Claims, 13 Drawing Sheets

U.S. PATENT DOCUMENTS

| | | | | | |
|---|---|---|---|---|---|
| 2,455,182 | A | * | 11/1948 | La Vallee | 62/131 |
| 2,803,480 | A | * | 8/1957 | Foster | 292/216 |
| 2,948,560 | A | * | 8/1960 | Rop | 292/45 |
| 2,966,864 | A | * | 1/1961 | Weaver | 109/63.5 |
| 3,222,115 | A | * | 12/1965 | Urbank | 312/333 |
| 3,245,744 | A | * | 4/1966 | Olson | 312/333 |
| 3,596,952 | A | * | 8/1971 | Hinkle et al. | 292/27 |
| 3,690,708 | A | * | 9/1972 | Worley et al. | 292/101 |
| 3,992,909 | A | * | 11/1976 | McGhee | 70/379 R |
| 4,662,689 | A | * | 5/1987 | Chatterson et al. | 312/219 |
| 5,048,877 | A | * | 9/1991 | Rogers et al. | 292/110 |
| 6,048,001 | A | * | 4/2000 | Miller et al. | 292/198 |
| 6,378,916 | B1 | * | 4/2002 | Huang | 292/27 |
| 6,910,749 | B2 | * | 6/2005 | Mueller | 312/333 |
| 2003/0117048 | A1 | | 6/2003 | Mueller | |
| 2007/0103041 | A1 | | 5/2007 | Kropf et al. | |
| 2007/0103043 | A1 | | 5/2007 | Kropf et al. | |
| 2008/0036345 | A1 | | 2/2008 | Kropf et al. | |

FOREIGN PATENT DOCUMENTS

| | | |
|---|---|---|
| EP | 1 314 842 | 5/2003 |
| EP | 1 785 062 | 5/2007 |
| EP | 1 785 063 | 5/2007 |
| EP | 1 887 172 | 2/2008 |
| WO | 2007/068019 | 6/2007 |

OTHER PUBLICATIONS

Austrian Patent Office Search Report dated Jan. 21, 2009 in Austrian Patent Application No. A 437/2008.

* cited by examiner 5
6
7
8
9
10
11
12
17
24
26
27
28
29
33
43
44
45
46
47
d
f

E
3
8
13
23
15
44
7
46
33
6
25
43
45
26
d
SR
OR
48
$S_1$
$S_2$

OR
E
3
8
13
23
15
48
44
33
e
d
7
43
25
45

LOCKABLE EJECTOR DEVICE FOR A FURNITURE PART MOVABLY SUPPORTED IN PIECE OF FURNITURE

This application is a Continuation of International application PCT/AT2009/000101, filed Mar. 13, 2009.

BACKGROUND OF THE INVENTION (1) Field of the Invention

The invention concerns a lockable ejector device for a furniture part movably supported in an article of furniture, comprising an immobilization device for arresting the movable furniture part in a closed end position and at least one ejector element for moving the movable furniture part out of the closed end position into an open position, wherein the immobilization device has at least two locking units which are coupled together and each have a respective receiving element for a respective engagement element.

(2) Description of Related Art

Such a device is known for example from Austrian utility model AT 8882 U1. In the device shown therein the two locking units are arranged at the rear end of the drawer and are coupled together by way of a torsion bar. In that case the additional space required in respect of the depth of the article of furniture has been found to be a disadvantage. In addition, coupling of the two locking units by means of the torsion bar involves a tendency for the front panel to assume an inclined position.

In view of this state of the art, the object of the invention is to provide a device of the kind set forth, which avoids those disadvantages and also allows easy maintenance and adjustment.

BRIEF SUMMARY OF THE INVENTION

According to the invention that object is attained in that at least two locking units are operatively connected together by way of a synchronization mechanism which has at least two coupling elements respectively associated with different locking units and at least one synchronization unit, wherein the coupling elements are movably coupled by means of the synchronization unit.

Coupling of the two locking units by way of a synchronization mechanism which has two coupling elements connected to the locking units and a synchronization unit which movably couples the two coupling elements reliably prevents inclined positioning of the front panel.

In that respect a structurally simple solution of the invention provides that at least two coupling elements are movably coupled in opposite relationship by means of the synchronization unit, wherein it has proven to be desirable for substantially play-free coupling of the two locking units if the synchronization unit has a stationarily arranged base element on which a synchronization element is rotatably movably supported.

A further embodiment of the invention provides that the base element is at least of a two-part structure and has a main element and an intermediate element, wherein the synchronization element is rotatably supported on the intermediate element, whereby the risk that the components or the synchronization unit are braced by the stationary mounting thereof is avoided.

In a preferred particularly stable embodiment it is provided that the synchronization element is formed by a gear and the synchronization unit has two racks which are mounted movably with a translatory movement on the base element and which are in engagement on opposite sides with the synchronization element and are or can be respectively connected in an end portion to a coupling element.

An alternative embodiment provides that the synchronization element is formed by a double-armed lever which is or can be connected in its two end portions to a respective coupling element.

Irrespective of the nature of the synchronization element a further embodiment of the invention provides that the at least two coupling elements respectively associated with different locking units are adapted to transmit or exert pulling and/or pressing forces. Desirably in that respect the coupling elements are of a flexurally stiff and/or torsionally stiff configuration, for which purpose it has proven to be desirable if the coupling elements are of a bar-shaped or tube-shaped configuration.

A further preferred embodiment of the invention provides that the immobilization device and the synchronization mechanism are arranged on the movable furniture part and the engagement elements are stationarily arranged on the article of furniture, wherein particularly simple mounting and maintenance of the device is afforded if the immobilization device and the synchronization mechanism are arranged at the underside of the movable furniture part, preferably in the region of the front panel of the movable furniture part.

In order to be able to adjust the front gap which remains between the front panel and the furniture carcass and which substantially corresponds to the triggering travel for the situation where the ejector device is based on the touch-latch principle, a further embodiment of the invention provides that the relative position of the receiving elements of the coupled locking units with respect to the engagement elements is linearly variable in respect of the depth of the article of furniture by means of at least one displacement device adapted to convert a rotary movement into a translatory movement, wherein desirably each locking unit has a displacement device for the receiving element.

In that respect a structurally simple solution is provided if at least one locking unit includes a slide portion which is supported linearly movably with respect to a base portion and on which the receiving element is arranged, wherein the displacement device for altering the relative position of the receiving element is of such a configuration and arrangement that it acts directly on the slide portion. In other words the fitter or the user can easily adjust the front gap without using a tool by turning the actuating element.

If at least one locking unit has a blocking mechanism for releasably fixing the preferably rotatably supported receiving element in a position of arresting the engagement element and if locking of the ejector device is effected by means of the blocking mechanism for the receiving element that overall provides a particularly compact solution involving few components, which obviously has a positive influence on the stability and the service life of the device according to the invention.

To avoid damage which can occur in the event of improper operation by a user, a further embodiment of the invention provides that at least one locking unit has an overload safety mechanism which includes at least two parts which are movably connected together and which allows damage-free opening of the movable furniture part even when the receiving element is fixed by means of the blocking mechanism in a position of arresting the engagement element.

In accordance with a further embodiment of the invention it is provided for that purpose the overload safety mechanism has two parts which are rotatably connected to each other and which are pivotable between a first end position and a second end position and between which a holding device is operable for releasably holding or for returning the parts which are rotatably connected together in the or into the first end position.

In that respect to provide a technical simple solution having few components it has proven to be advantageous if the receiving element has a base element and a locking element movably connected to the base element, wherein the blocking mechanism acts on the base element and the at least two parts of the overload safety mechanism, that are movably connected together, are formed by the base element and the locking element of the receiving element.

Although implementation of the concept of the invention would also be possible when only one side of the movable furniture part is provided with a locking unit which has a blocking mechanism, an overload safety mechanism and a displacement device, a preferred embodiment of the invention provides that each locking unit includes a blocking mechanism, an overload safety mechanism and a displacement device.

In a further embodiment of the invention the ejector device or the ejector element can be arranged on the locking unit.

In practice it has been found that a particularly simple and stable solution is achieved when the ejector device or the ejector element is arranged separately from the immobilization device on the movable furniture part or on the article of furniture, wherein it has proven to be particularly advantageous if the ejector device or the ejector element is arranged in the guide system for a drawer forming the movable furniture part, preferably on the carcass rail.

The invention further relates to an article of furniture having a lockable ejector device as set forth in one of claims 1 through 25.

BRIEF SUMMARY OF THE DRAWINGS

Further advantages and details of the invention are described more fully by means of the specific description hereinafter with reference to the embodiments illustrated in the drawing in which.

DETAILED DESCRIPTION OF THE INVENTION

Figure 1:
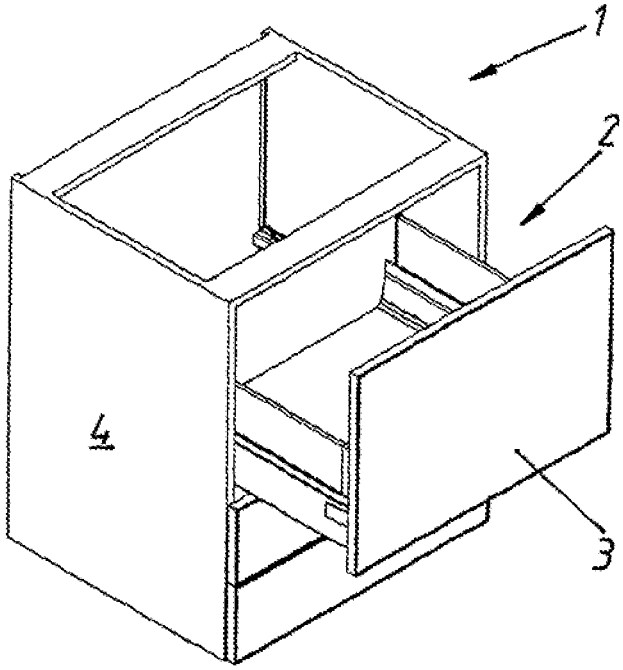
FIG. 1 shows an article of furniture having a movably supported furniture part.

FIG. 1 quite generally shows an article of furniture 1 having a furniture part 2 supported movably therein. In this case opening of the movable furniture part 2 formed by a drawer is effected by way of a touch-latch mechanism, that is to say the user pushes the movable furniture part 2 from a closed end position E in the closing direction SR of the movable furniture part 2 further into the article of furniture 1 by a predetermined distance by applying force to the handle-less front panel 3, whereby locking of an ejector device is released and the movable furniture part 2 is extended into an open position out of the article of furniture 1 by means of the ejector device.

Figure 2A:
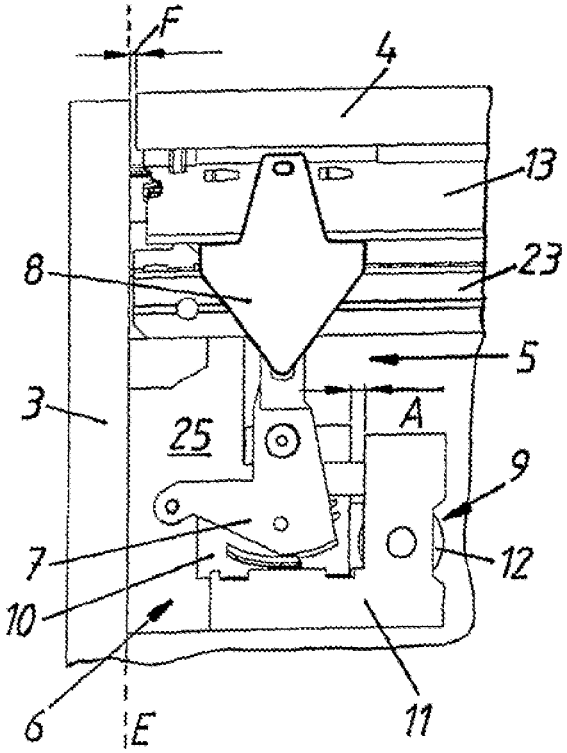
FIGS. 2*a* and 2*b* show an embodiment of the invention with a receiving element mounted displaceably in the depth of the article of furniture.
Figure 2B:
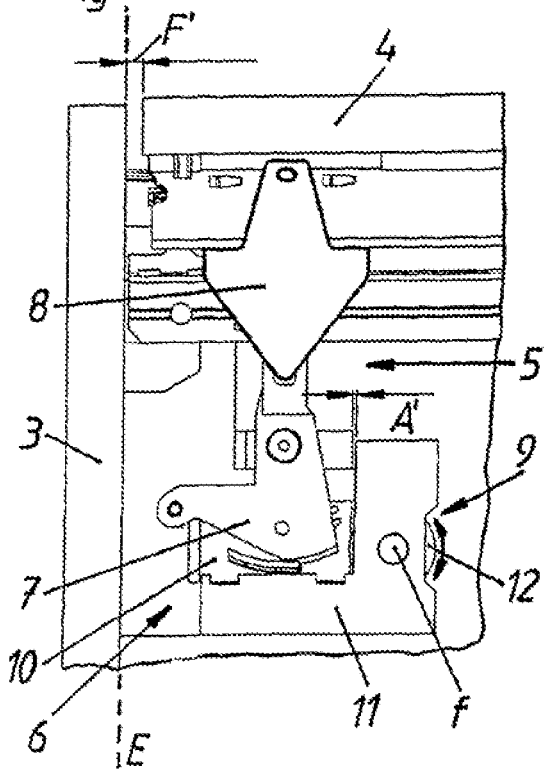

FIGS. 2*a* and 2*b* show a portion of a view from below of a furniture part 2 supported movably in an article of furniture 1.

In this case the movable furniture part 2 is movably guided by means of a drawer rail 23 in a carcass rail 13 stationarily arranged on the body or carcass 4 of the article of furniture 1. Arranged on the underside 25 of the movable furniture part 2 in the region of the front panel 3 is an immobilization device 5 for arresting the movable furniture part 2 in a closed end position E. The immobilization device 5 includes a locking unit 6 having a receiving element 7 which at least in the closed end position E is in engagement with an engagement element 8 arranged stationarily on the carcass rail 13.

In order to be able to change the front gap F corresponding to the spacing between the front panel 3 and the furniture carcass 4 in the closed end position E of the movable furniture part 2 and thus the release travel for the touch-latch mechanism, in the embodiment illustrated in FIGS. 2*a* and 2*b* the receiving element 7 for the engagement element 8 is arranged on a slide portion 10 supported linearly movably in a base portion 11 of the locking unit 6 and the locking unit 6 has a displacement device 9, by means of which the relative position of the receiving element 7 with respect to the engagement element 8 can be altered in the depth of the article of furniture 1.

The displacement device 9 is adapted to convert a rotary movement into a translatory movement and for that purpose has a rotatably supported actuating element 12, the axis of rotation f of which extends substantially normal to the main plane of the locking unit 6, and which in the illustrated embodiment acts directly on the linearly movably supported slide portion 10.

Starting from the position shown in FIG. 2*a* with the front gap F between the front panel 3 and the furniture carcass 4 and the spacing A between the slide portion 10 and the base portion 11 of the locking unit 6 therefore the relative position of the receiving element 7 with respect to the engagement element 8 can be altered by rotating the actuating element 12 of the displacement device 9 so that, as shown in FIG. 2*b*, the result is a larger front gap F' and a smaller spacing A' between the slide portion 10 and the base portion 11 of the locking unit 6. It will be appreciated that that change in position of the receiving element 7 relative to the engagement element 8 can be effected in both directions, wherein the value of the front gap F, F' behaves in inverse proportion to the value of the spacing A, A', that is to say the front gap F, F' becomes greater, as the spacing A, A' between the slide portion 10 and the base portion 11 decreases to the same extent, and vice-versa. That advantageous configuration of the immobilization device 5 and the arrangement thereof on the underside 25 of the movable furniture part 2 in the region of the front panel 3 provides that the user can easily alter or adjust the front gap F, F' and thus the position of the movable furniture part 2 in the closed end position E without a tool.

Figure 3:
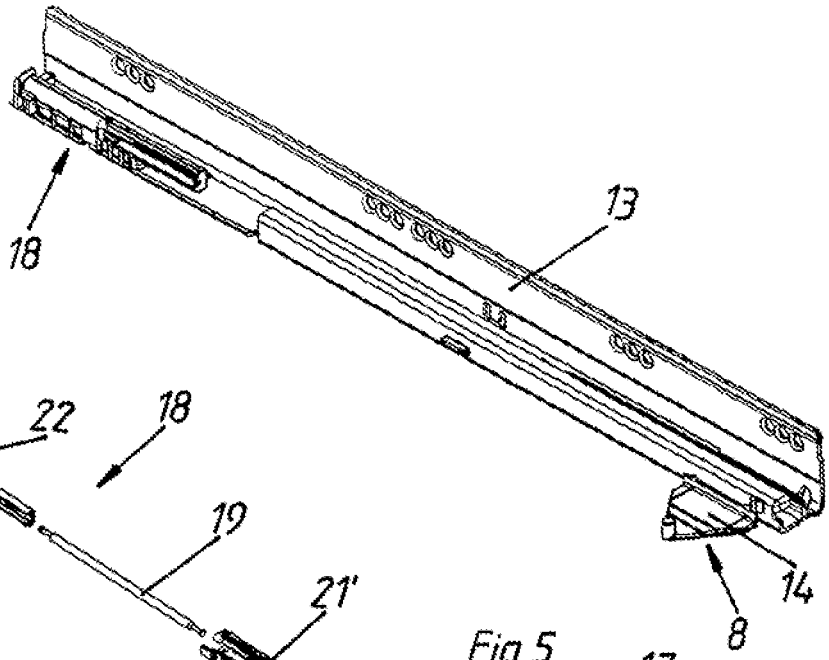
FIG. 3 shows the carcass rail of a guide system for the movably supported furniture part.

The carcass rail 13 which is arranged or which is to be arranged on the furniture carcass 4 is shown in FIG. 3. Arranged on the carcass rail 13 in the front end portion is the engagement element 8 while arranged in the rear end portion is an ejector device 18, mounting of the carcass rail 13 in the article of furniture 1 being so effected that the engagement element 8 is at front in the region of the front of the article of furniture.

Figure 4:
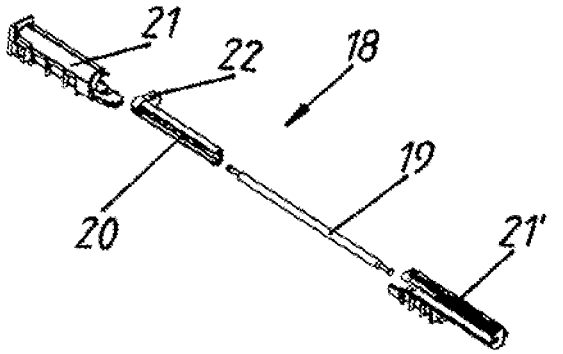
FIG. 4 shows an exploded view of an ejector device.

FIG. 4 shows an exploded view of the ejector device 18 which in the illustrated embodiment has a two-part housing 21, 21' in which an ejector element 20 acted upon by a force storage means 19 and having an abutment 22 provided thereon is movably supported. In this embodiment locking of the ejector device 18 is effected by way of the engagement element 8 which in the closed end position of the movable furniture part 2 is arrested by means of the receiving element 7 of the locking unit 6. After unlocking of the ejector device 18, that is to say when the engagement element 8 is released from the locking unit 6 the force storage means 19 is unloaded and in that way moves the ejector element 20, the movement of which is transmitted by way of the abutment 22 to the drawer rail 23 or directly to the movable furniture part 2.

Figure 5:
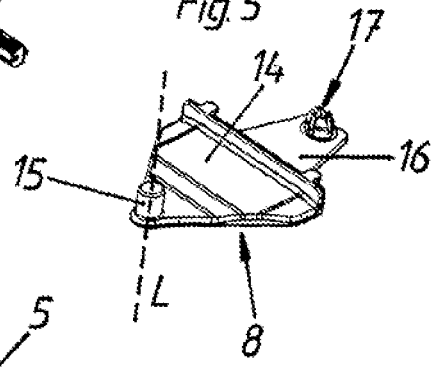
FIG. 5 shows an embodiment of an engagement element.

The engagement element 8 shown in FIG. 5 has a plate-shaped main element 14 which is or can be positively lockingly connected to the carcass rail 13 by way of the latching head 17 on an extension 16. In the end portion of the engagement element 8, that is opposite to the latching head 17, arranged on the plate-shaped main element 14 is a pin 15, the longitudinal axis L of which extends substantially normal to the main plane of the main element 14. In the closed end position E of the movable furniture part 2 the engagement element 8 is in engagement by way of the pin 15 with the receiving element 7 of the locking unit 6, whereby on the one hand the movable furniture part 2 is arrested in its closed end position E and on the other hand the ejector device 18 is locked.

Figure 6:
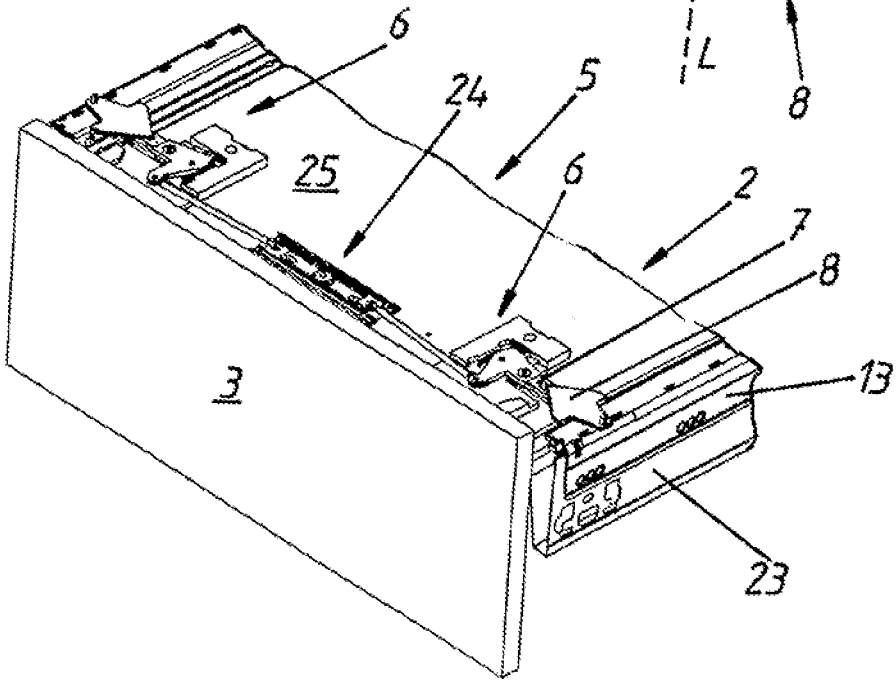
FIG. 6 shows a perspective view onto the underside of a first embodiment of a movably supported furniture part having an immobilization device comprising two mutually coupled locking units.

FIG. 6 shows a three-quarter view onto the underside of a movable furniture part 2. In this case the movable furniture part 2 is formed by a drawer, an immobilization device 5 being arranged on the underside 25 in the region of the front panel 3. The immobilization device 5 has two locking units 6 coupled by means of a synchronization mechanism 24. The two locking units 6 each have a respective receiving element 7 which are respectively in engagement with an engagement element 8 arranged on the two carcass rails 13. In this case the movable furniture part 2 is supported movably by way of a drawer rail 23 in the carcass rail 13.

Figure 7A:
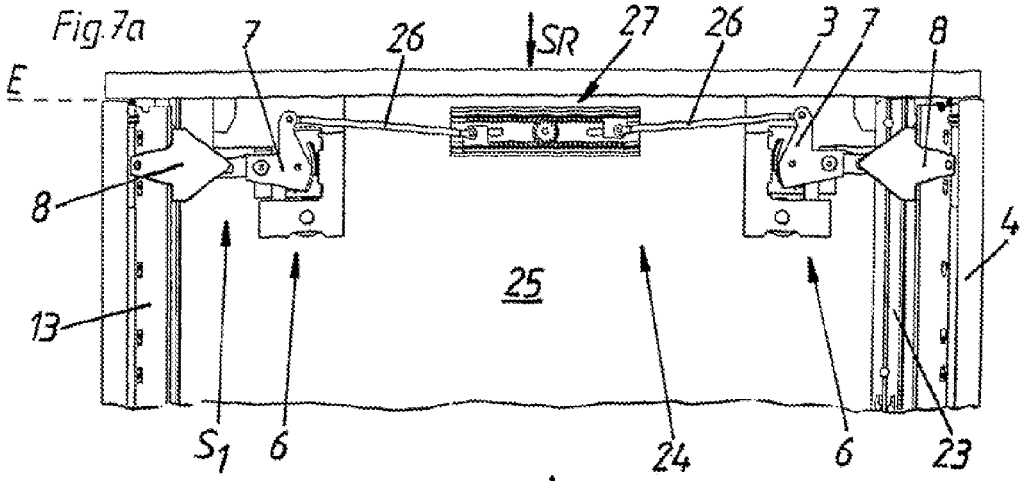
FIGS. 7*a* and 7*b* show a plan view of the embodiment of FIG. 6 in different positions of the movably supported furniture part.
Figure 7B:
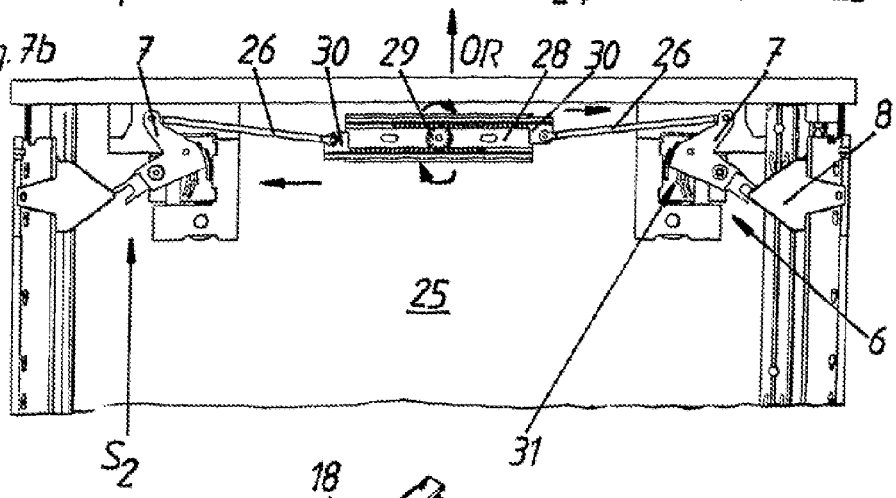

FIGS. 7*a* and 7*b* show the FIG. 6 embodiment in two different positions of the movable furniture part 2. In this case FIG. 7*a* shows the movable furniture part 2 in the closed end position E and the two receiving elements 7 of the locking units 6 are in engagement with the engagement elements 8 on the carcass rails 13. Coupling of the locking units 6 by means of the synchronization mechanism 24 is effected by way of coupling elements 26 which in the illustrated embodiment are bar-shaped and at their one end are rotationally hingedly connected to the receiving elements 7 and at their other end are rotationally hingedly connected to the synchronization unit 27.

If now starting from the closed end position E shown in FIG. 7*a*, the movable furniture part 2 is pushed into the furniture carcass 4 by applying force to the front panel 3 in the closing direction SR the blocking mechanism 31 is released and the locking action between the receiving elements 7 and the engagement elements 8 is removed so that the receiving elements 7 are pivoted from their second position $s_1$ shown in FIG. 7*a* of arresting the engagement element 8 into a second position $s_2$ shown in FIG. 7*b* of releasing the engagement element 8, by means of the ejector device.

The coupling of the two locking units 6 arranged at opposite sides on the movable furniture part 2, by way of a synchronization mechanism 24, ensures that the removal of the locking action and thus triggering of the ejector device takes place substantially simultaneously, irrespective of the position on the front panel 3 at which the user applies the necessary triggering force in the closing direction SR of the movable furniture part 2.

For that purpose the synchronization mechanism 24 has a synchronization unit 27, wherein the receiving elements 7 of the locking units 6 are connected to the synchronization unit 27 by way of coupling elements 26 which are coupled for movement in opposite relationship by means of the synchronization unit 27.

In the embodiments shown in FIGS. 7*a* and 7*b*, after release of the blocking mechanism 31, the receiving element 7 which is shown at the right is pivoted towards the right by the extension movement of the movable furniture part 2 and by way of the coupling element 26 also pulls the rack 30 of the synchronization unit 27 towards the right. The second rack 30 of the synchronization unit 27 is displaced towards the left in the Figure by way of the synchronization element 29 formed in the illustrated embodiment by a gear, whereby the coupling element 26 shown at the left in the Figure is displaced from right towards left by coupling in respect of motion in opposite relationship, and the left receiving element 7 is pivoted towards the left. In the illustrated embodiment therefore coupled in respect of motion in opposite relationship signifies both a reversal of the direction of movement and also a change between a pulling and a pushing force.

Figure 8:
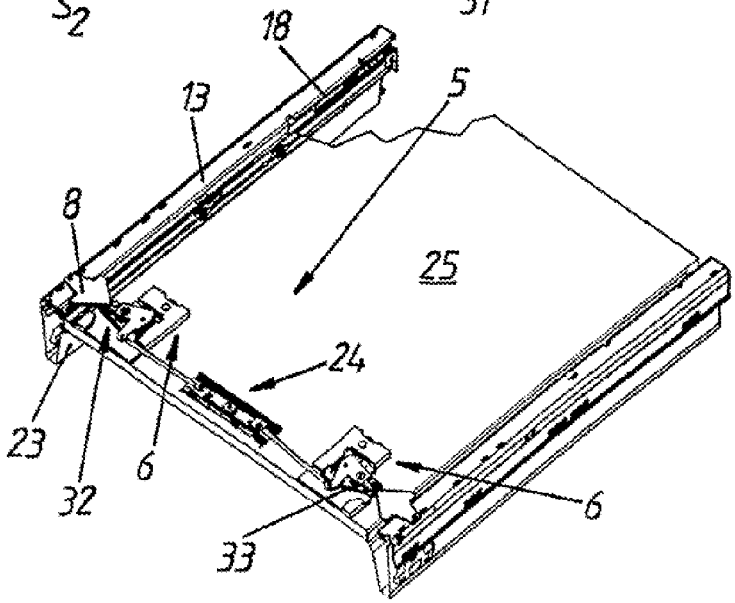
FIG. 8 shows a perspective view onto the underside of a second embodiment of a movably supported furniture part having an immobilization device comprising two locking units which are coupled by way of a synchronization mechanism and have an overload safety mechanism.

FIG. 8 shows a further embodiment in which the locking units 6 additionally have an overload safety mechanism 32 which allows damage-free opening of the movable furniture part 2 even when the receiving element 7 is fixed by means of the blocking mechanism 31 in a second position $s_1$ of arresting the engagement element 8.

Figure 9A:
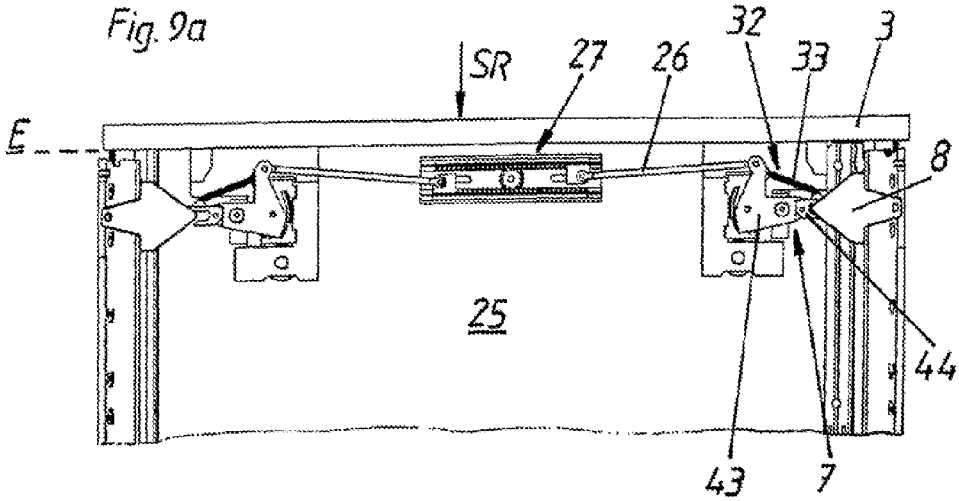
FIGS. 9*a* and 9*b* show the FIG. 8 embodiment as a view onto the underside of the movable furniture part in different positions.

For the purpose, as shown in FIG. 9*a*, the receiving element 7 is of a two-part structure, wherein the base element 43 and the locking element 44 are rotatably connected together and the blocking mechanism 31 acts on the base element 43. The base element 43 and the locking element 44 of the receiving element 7 in this embodiment form the two parts of the overload safety mechanism 32, which are pivotably connected together and are pivotable between a first and a second end position, wherein a holding device 33 is operative between the base element 43 and the locking element 44. The mode of operation of the overload safety mechanism 32 is described in further detail with reference to FIGS. 30*a* through 30*g*.

Figure 9B:
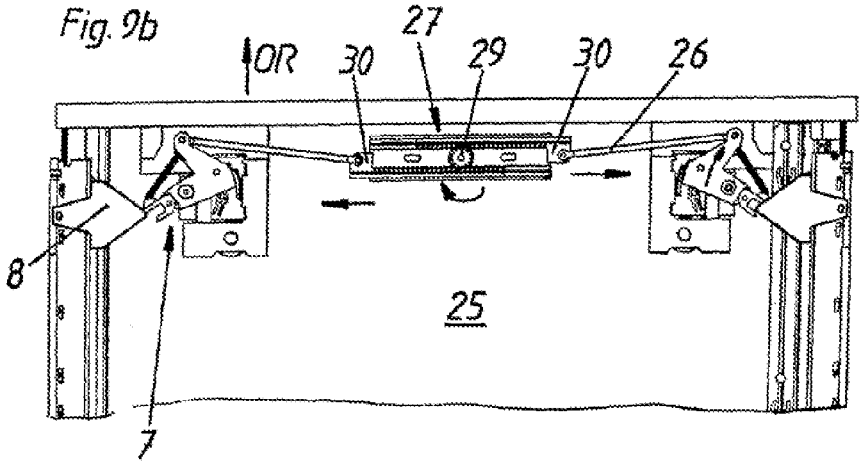

In the positions shown in FIGS. 9*a* and 9*b*, opening of the movable furniture part 2 was effected by applying the triggering force to the front panel 3 in the closing direction SR (FIG. 9*a*), whereby the blocking mechanism 31 is released and triggering of the overload safety mechanism 32 is not needed. In other respects the embodiment in FIGS. 9*a* and 9*b* corresponds to the embodiment of FIGS. 7*a* and 7*b*, for which reason it will not be described in detail again here.

Figure 10:
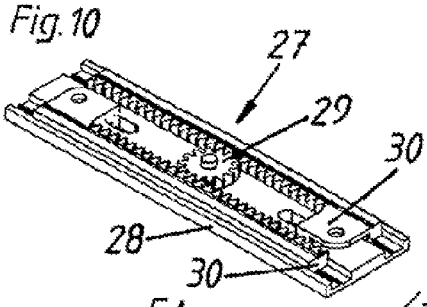
FIG. 10 shows a perspective view of a first embodiment of a synchronization unit.

A first preferred embodiment of a synchronization unit 27 is shown as a perspective view in FIG. 10. The synchronization unit 27 includes a base element 28 at which a synchronization element 29 is rotatably supported. In the illustrated embodiment the synchronization element 29 is formed by a gear and two racks 30 are supported movably with a translatory movement in guide tracks on the base element 28 on opposite sides of the synchronization element 29, engaging thereinto.

Figure 11A:
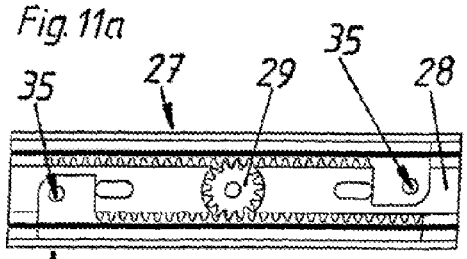
FIGS. 11*a* and 11*b* show a plan view of the embodiment of FIG. 10.
Figure 11B:
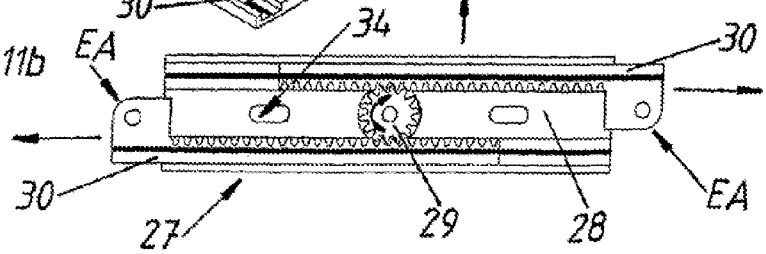

FIGS. 11*a* and 11*b* show plan views of two different positions of the synchronization unit 27 of FIG. 10. Starting from the position in FIG. 11*a*, upon a pivotal movement of the receiving elements 7 of the locking units 6, the two racks 30 are pushed or pulled in opposite directions (FIG. 11*b*), wherein the oppositely directed movement of the racks 30 is coupled by way of the rotating synchronization element 29 and takes place in synchronized relationship.

For fixing the synchronization unit 27 to the movable furniture part 2 the base element 28 has through openings 34 which in the illustrated embodiment are in the form of slots. The synchronization unit 27 is connected to the coupling elements 26 by way of receiving openings 35 provided in the outer end portions of the racks 30.

Figure 12:
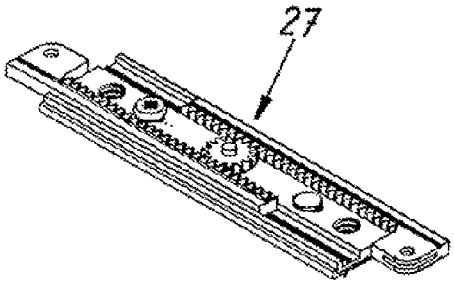
FIG. 12 shows a perspective view of a further embodiment of a synchronization unit.
Figure 13:
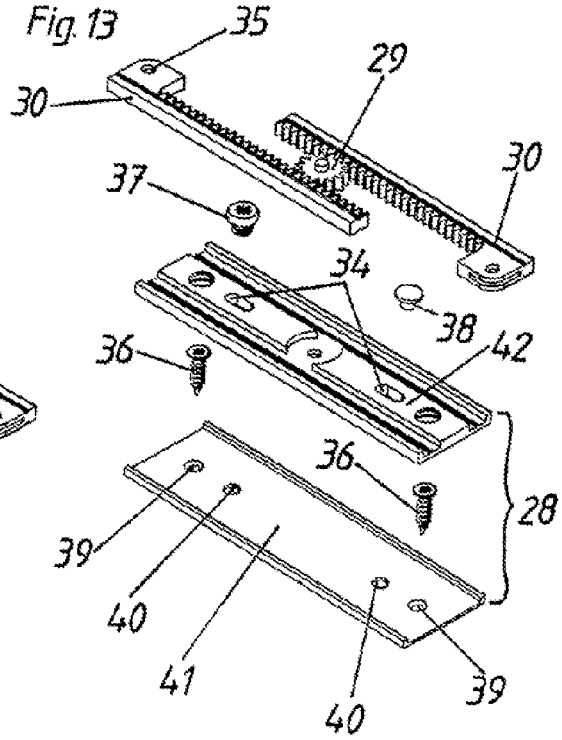
FIG. 13 shows an exploded view of the FIG. 12 embodiment.

A further embodiment of a synchronization unit 27 is shown in FIGS. 12 through 14*b*. The synchronization unit shown as a perspective view in FIG. 12 differs from the embodiment of FIG. 10 in that the base element 28 is of a two-part structure. As can be seen from FIG. 13 showing an exploded view of the FIG. 12 embodiment the base element 28 has a main element 41 and an intermediate element 42, wherein the synchronization element 29 and the two racks 30 are arranged on the intermediate element 42.

In this embodiment the main element 41 has two through openings 39 for receiving fixing means 36 with which the main element 41 is fixed to the movable furniture part 2. The receiving openings 40 also arranged on the main element 41 serve for fixing the intermediate element 42 to the main element 41. For that reason slots 34 are provided on the intermediate element 42, wherein in the illustrated embodiment fixing of the intermediate element 42 to the main element 41 is effected by way of a guide pin 38 and a fixing element 37.

This structure avoids the racks 30 or the coupling elements 26 being stressed by screwing of the base element 28 to the underside 25 of the movable furniture part 2, for example at the bottom of a drawer. By virtue of the two-part structure of the base element 28, in a first step the main element 41 can be mounted on the underside 25 of the movable furniture part 2, in which case the fixing element 37 formed by a clamping screw, for arresting the intermediate element 42, is firstly released and it is only after mounting of the synchronization unit 27 to the movable furniture part 2 that it is tightened in a further step, which permits substantially stress-free mounting of the synchronization unit 27.

Figure 14A:
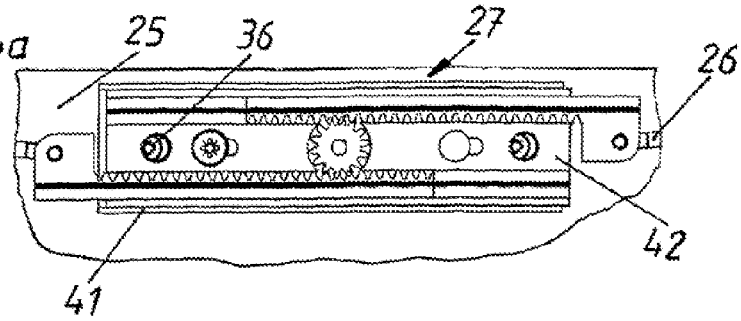
FIGS. 14*a* and 14*b* show a plan view of the embodiment of FIG. 12 in different positions.
Figure 14B:
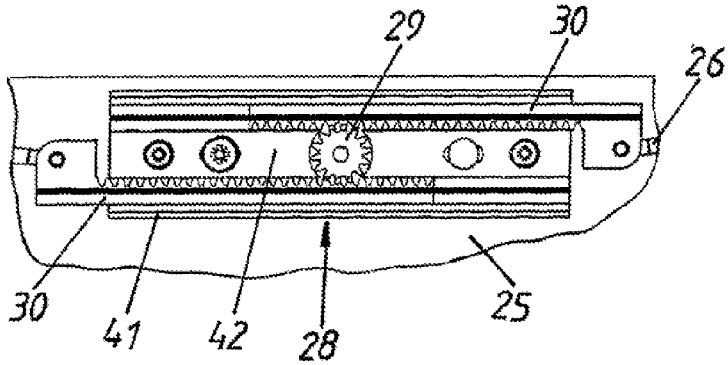

FIGS. 14*a* and 14*b* show two different mounting positions of the synchronization unit 27 in FIG. 12, wherein as shown in FIG. 14*b* the main element 41 and the intermediate element 42 are in congruent relationship and as shown in FIG. 14*a* the intermediate element 42 is displaced towards the right in relation to the main element 41.

Figure 15:
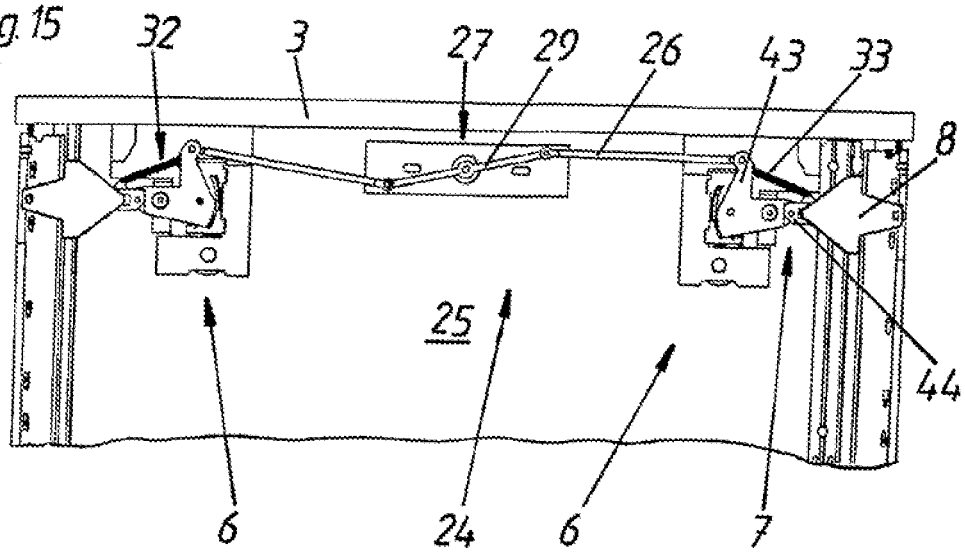
FIG. 15 shows a perspective view onto the underside of a second embodiment of a movably supported furniture part having an immobilization device comprising two locking units which are coupled by way of a synchronization mechanism and have an overload safety mechanism.
Figure 16A:
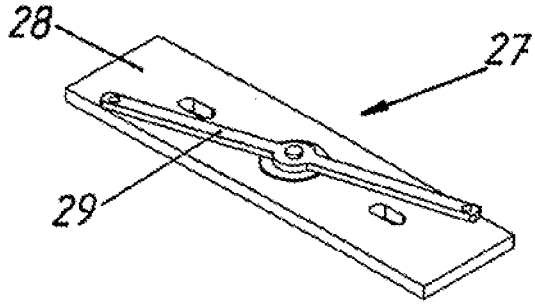
FIGS. 16*a* and 16*b* show a perspective view onto a further embodiment of a synchronization unit.
Figure 16B:
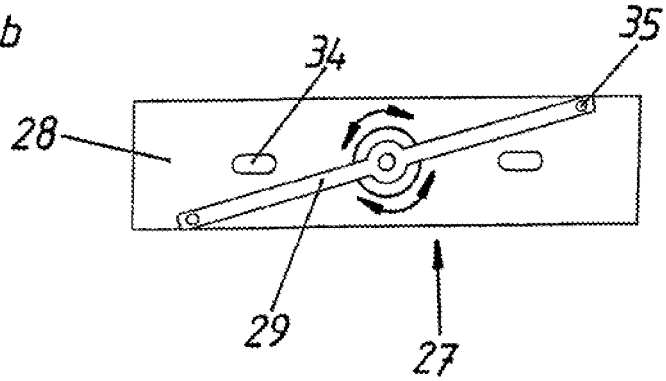

The FIG. 15 embodiment differs from the embodiment of FIG. 9*a* in the configuration of the synchronization unit 27. As can be seen in particular from FIGS. 16*a* and 16*b* in this embodiment the synchronization element 29 is formed by a double-armed lever which in its two opposite end portions has receiving openings 35 for connection to the coupling elements 26.

The synchronization element 29 is in turn mounted rotatably on the base element 28. As is already the case with the above-described embodiments the movements of the receiving elements 7 are transmitted by way of the coupling elements 26 to the synchronization unit 27, but it will be noted that in this embodiment the coupling elements 26 are connected directly to the synchronization element 29. Just as in the embodiments with two racks 30 and a gear, in this embodiment also the two coupling elements 26 are coupled in respect of movement in opposite relationship by way of the synchronization element 29 formed by a double-armed lever.

An immobilization device 5 in which the two locking units 6 are synchronously coupled together by way of a synchronization mechanism 24 having a synchronization unit 27 and two coupling elements 26 is shown as a view from above in FIG. 17*a* and a three-quarter view from below in FIG. 17*b*. In this case the synchronization element 29 of the synchronization unit 27 is formed by a double-armed lever.

Figures 17A, 17B, 18:
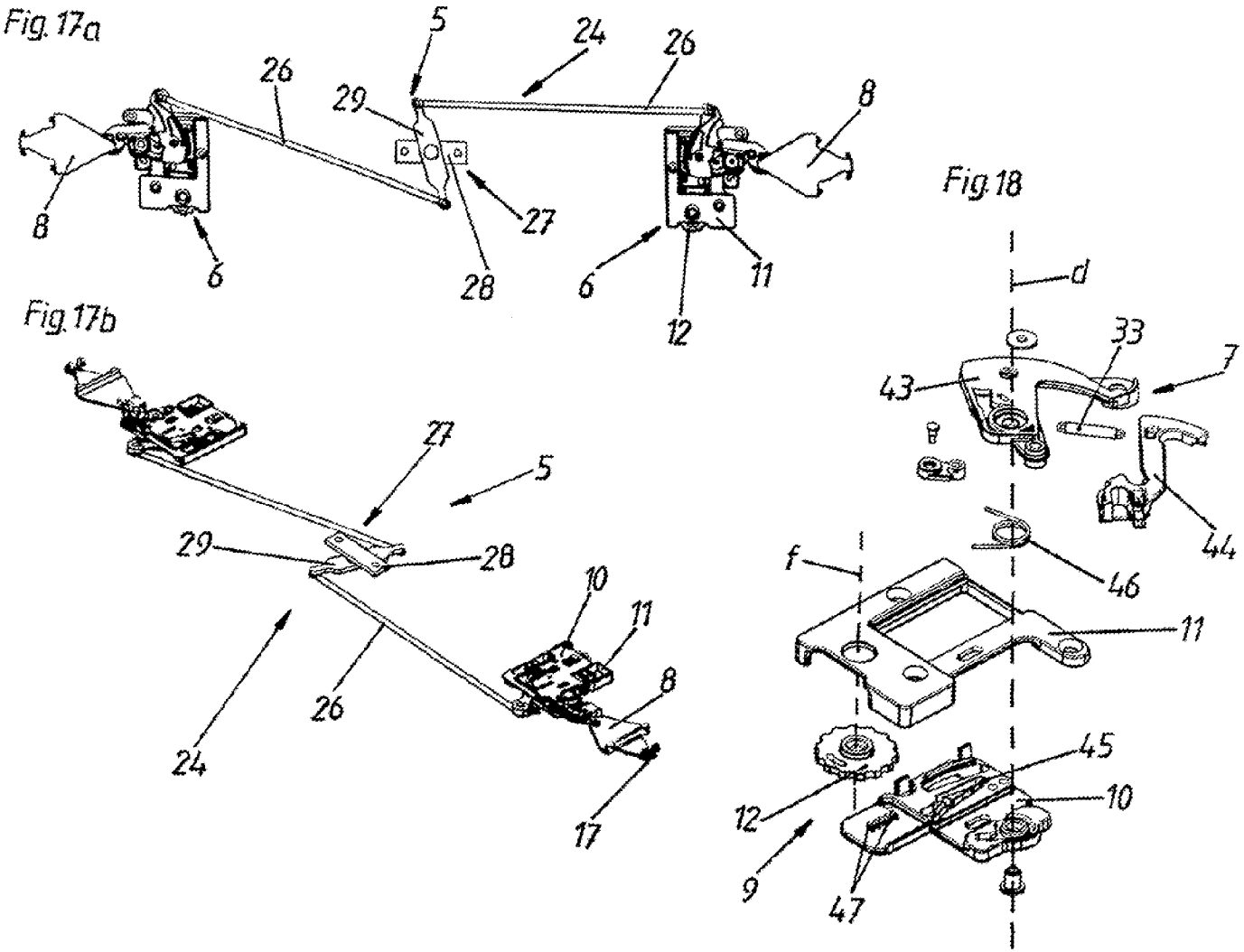
FIGS. 17*a* and 17*b* show views from above and below of a further embodiment of an immobilization device comprising two locking units coupled by way of a synchronization mechanism.
FIG. 18 shows an exploded view of a locking unit of the embodiment of FIGS. 17*a* and 17*b*, FIGS. 19*a* and 19*b* show an exploded view and a perspective view of a further embodiment of a locking unit having a two-part receiving element and an overload safety mechanism.

The locking unit 6 in the embodiment of FIGS. 17*a* and 17*b* is shown in an exploded view in FIG. 18. The locking unit 6 is fixed to the movable furniture part 2 by way of the base portion 11 in which a slide portion 10 is linearly movably arranged. The change in position of the slide part 10 in relation to the base portion 11 is effected by way of a displacement device 9 having an actuating element 12. The actuating element 12 is mounted to the base portion 11 rotatably about the axis of rotation f and on its underside towards the slide portion 10 has a spiral-shaped sliding guide track (not shown) operatively connected to guide means 47 arranged on the slide portion 10, that is to say rotation of the actuating element 12 causes a linear displacement of the slide portion 10.

The receiving element 7 is mounted to the slide portion 10 rotatably about the axis of rotation d, wherein in the illustrated embodiment the receiving element 7 is of a two-part structure and has a rotatably supported base element 43 and a locking element 44 rotatably hingedly connected to the base element 43. The base element 43 and the locking element 44 form at the same time the two hingedly connected parts of an overload mechanism 32 and are connected together by way of a holding device 33 formed by a tension spring.

In the illustrated embodiment the blocking mechanism 31 for arresting the receiving element 7 in a position $s_1$ of arresting the engagement element 8 includes a sliding guide track 45 and is operative between the linearly movable slide portion 10 and the receiving element 7 which is rotatably supported thereat and which is acted upon by a spring 46.

Figures 19A, 19B, 20A, 20B:
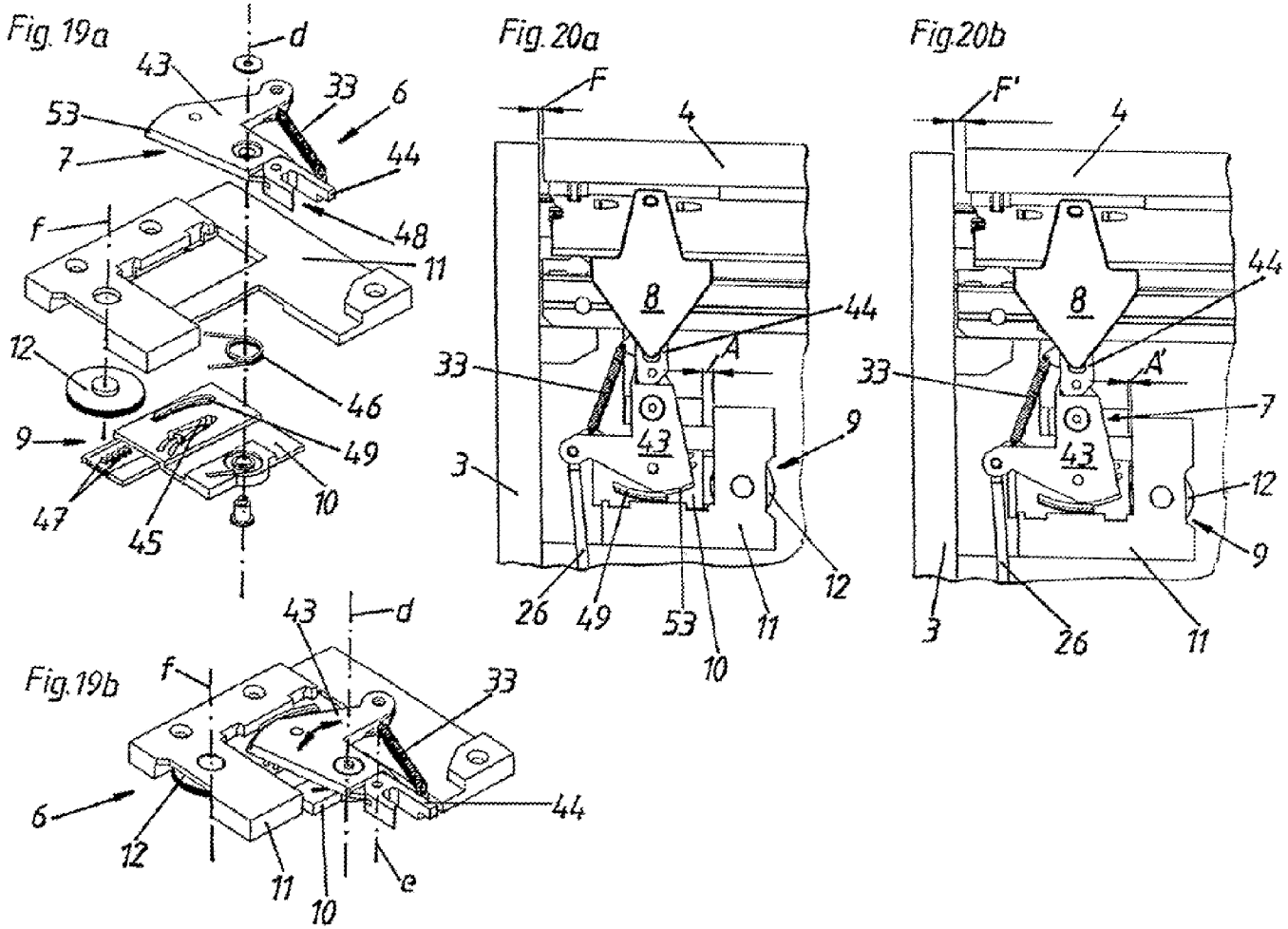
FIGS. 20*a* and 20*b* show views of portions of a further embodiment of the invention with a locking unit as shown in FIGS. 19*a* and 19*b*, FIGS. 21*a* and 21*b* show a perspective view and an exploded view of a further embodiment of a receiving element having an overload safety mechanism.

A further embodiment of a locking unit 6 is shown as an exploded view in FIG. 19*a* and a perspective view in FIG. 19*b*. The embodiment of FIGS. 19*a* and 19*b* differs from the embodiment of FIG. 18 only by virtue of the parts being of a different configuration. The mode of operation of the locking unit 6 corresponds to that in accordance with the above-described embodiment, and for that reason it will not be described in detail once again here.

FIGS. 20*a* and 20*b* each show a locking unit 6 as illustrated in FIG. 19*b*, arranged on a movable furniture part 2, wherein the locking unit 6 is respectively in engagement with the engagement element 8 and is coupled in respect of movement by way of a coupling element 26 which is part of a synchronization mechanism 24 to a second locking unit 6 arranged on the opposite side of the movable furniture part 2.

In this case, starting from the position shown in FIG. 20*a*, by rotation of the actuating element 12 of the displacement device 9, the front gap F or the spacing A between the slide portion 10 and the base element 11 has been changed, whereby there is a larger front gap F' or a smaller spacing A' (FIG. 20*b*), that is to say the position of the movable furniture part 2 in the furniture carcass 4 in respect of the depth of the article of furniture 1 can be easily adapted by the user by rotating the actuating element 12 of the displacement device 9.

In the embodiment shown in FIGS. 21*a* through 22*b*, the two rotatably connected parts of the overload safety mechanism 32 are again formed by a base element 43 and a locking element 44 of a receiving element 7. Unlike the embodiments of FIGS. 18 and 19 in this embodiment the holding device 33 is of a two-part structure, a part 50 being arranged on the locking element 44 and the second part 51 on the base element 43. In this case the first part 50 of the holding device 33 is in the form of a latching head and the second part 51 of the holding device 33 is in the form of a latching receiving means so that the holding device 33 acts in positively locking relationship.

Figure 21A:
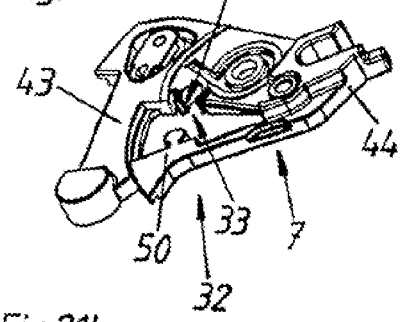
Figure 23A:
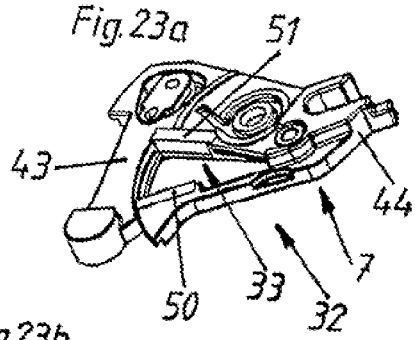
FIGS. 23*a* and 23*b* show a further embodiment of a receiving element with an overload safety mechanism.
Figure 21B:
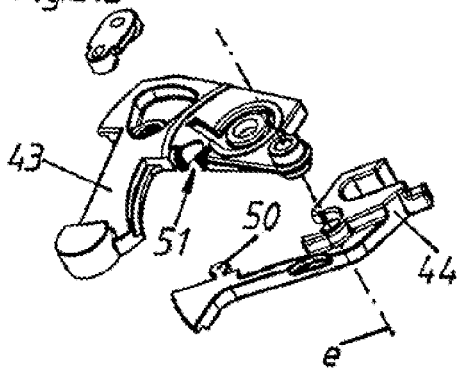
Figure 23B:
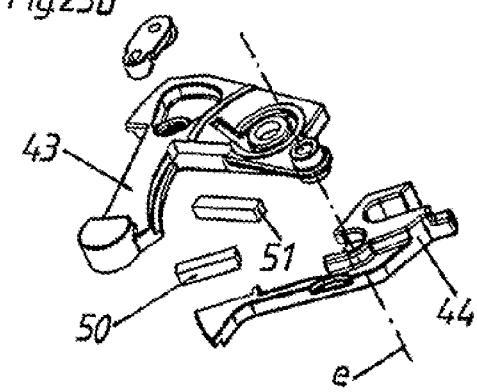
Figure 22A:
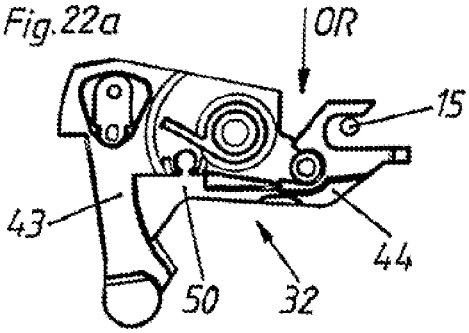
FIGS. 22*a* and 22*b* show a plan view of the embodiment of FIG. 21*a* in different positions.
Figure 24A:
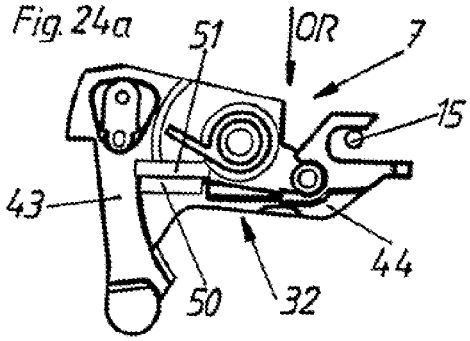
FIGS. 24*a* and 24*b* show a plan view of the embodiment of FIG. 23*a* in different positions.
Figure 22B:
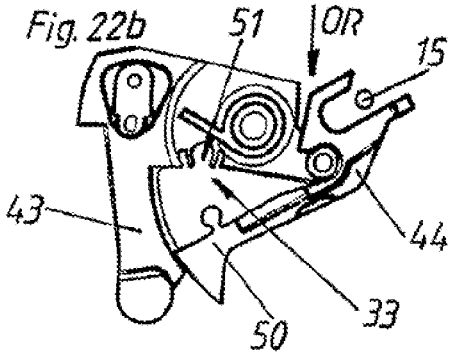
Figure 24B:
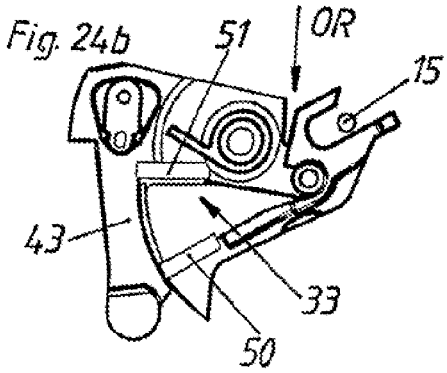
Figure 28:
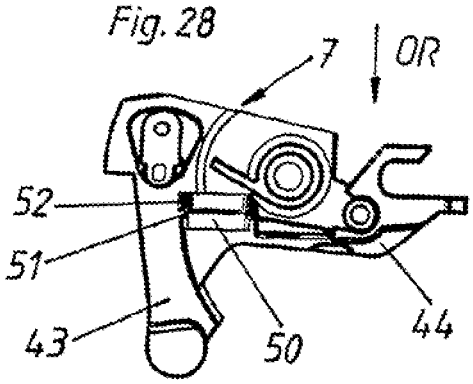
FIG. 28 shows a further position of the receiving element of FIG. 25, FIGS. 29*a* through 29*d* show different positions of the receiving element of a locking unit during a normal opening process.
Figure 25:
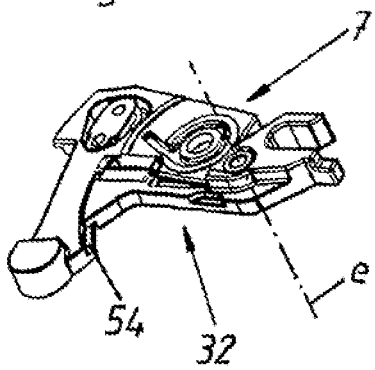
FIG. 25 shows a further embodiment of a receiving element with an overload safety mechanism.

FIG. 21*a* shows a perspective view of the embodiment in an open position of the holding device 33, FIG. 21*b* shows an exploded view of the holding device 33 in FIG. 21*a*. FIG. 22*a* shows the principle of the arrangement of the embodiment of FIG. 21*a* as a plan view, more specifically with the holding device 33 closed. In other words the movable furniture part 2 is disposed in its closed end position E so that the locking element 44 arrests the pin 15 of the engagement element 8. When now the movable furniture part 2 is pulled by user in the opening direction OR, without the blocking mechanism 31 being previously released by pressing the movable furniture part 2 inwardly in the closing direction SR, the holding device 33 opens due to the force that the pin 15 exerts on the locking element 44, in other words the positively locking connection between the parts 50 and 51 is released and the movable furniture part 2 can be moved into an open position without the receiving element 7 being damaged.

The embodiment shown in FIGS. 23*a* through 24*b* of a receiving element 7 with a blocking mechanism 32 operates in a similar manner to the embodiment shown in FIGS. 21*a* through 22*b*. The embodiment of FIGS. 23*a* through 24*b* differs from the embodiment of FIGS. 21*a* through 22*b* in the nature of the two parts 50, 51 of the holding device 33. In this embodiment the two parts 50 and 51 of the holding device 33 are formed by two magnets which exert an attracting action on each other.

A very similar embodiment is shown in FIGS. 25 through 28. Once again this embodiment differs in the nature of the two parts 50, 51 of the holding device 33, wherein the first part 50 of the holding device 33 is formed by a magnet while the second part 51 of the holding device 33 is formed by a metallic counterpart pole in the form of a loop arranged supported by way of two springs 52 on the base element 43 of the receiving element 7.

Figure 26B:
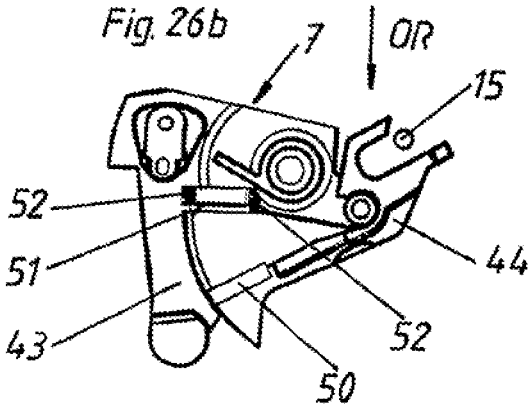
FIGS. 26*a* and 26*b* show a plan view of the embodiment of FIG. 25 in different positions.
Figure 26A:
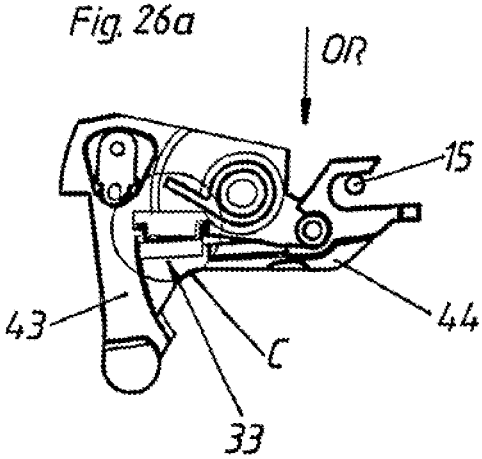
Figure 27:
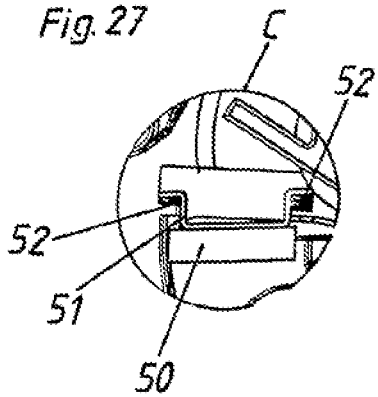
FIG. 27 shows the detail C of FIG. 26*a* on an enlarged scale.

This configuration has the advantage that the separation force between the two parts 50, 51 of the holding device 33 is increased as—as can be seen in particular from FIGS. 26*a* and 27—when a separation force is operative between the two parts 50, 51, that firstly involves an inclined positioning of the part 51 of the holding device 33 before the part 50 actually separates by breaking away. In that way on the one hand the operative force of the ejector device can be increased and on the other hand a rebound of the movable furniture part 2 upon closure can be at least partially absorbed by means of the holding device 33.

Reference is now made to FIGS. 29*a* through 29*d* to describe different positions of the receiving element 7 of the locking unit 6 in the embodiment of FIG. 20*a* during a normal opening process. In that respect the expression normal opening process is used to denote release of the locking action by pressing the movable furniture part 2 inwardly into a position behind the closed end position E, by the user.

Figures 29A, 29B, 29C, 29D:
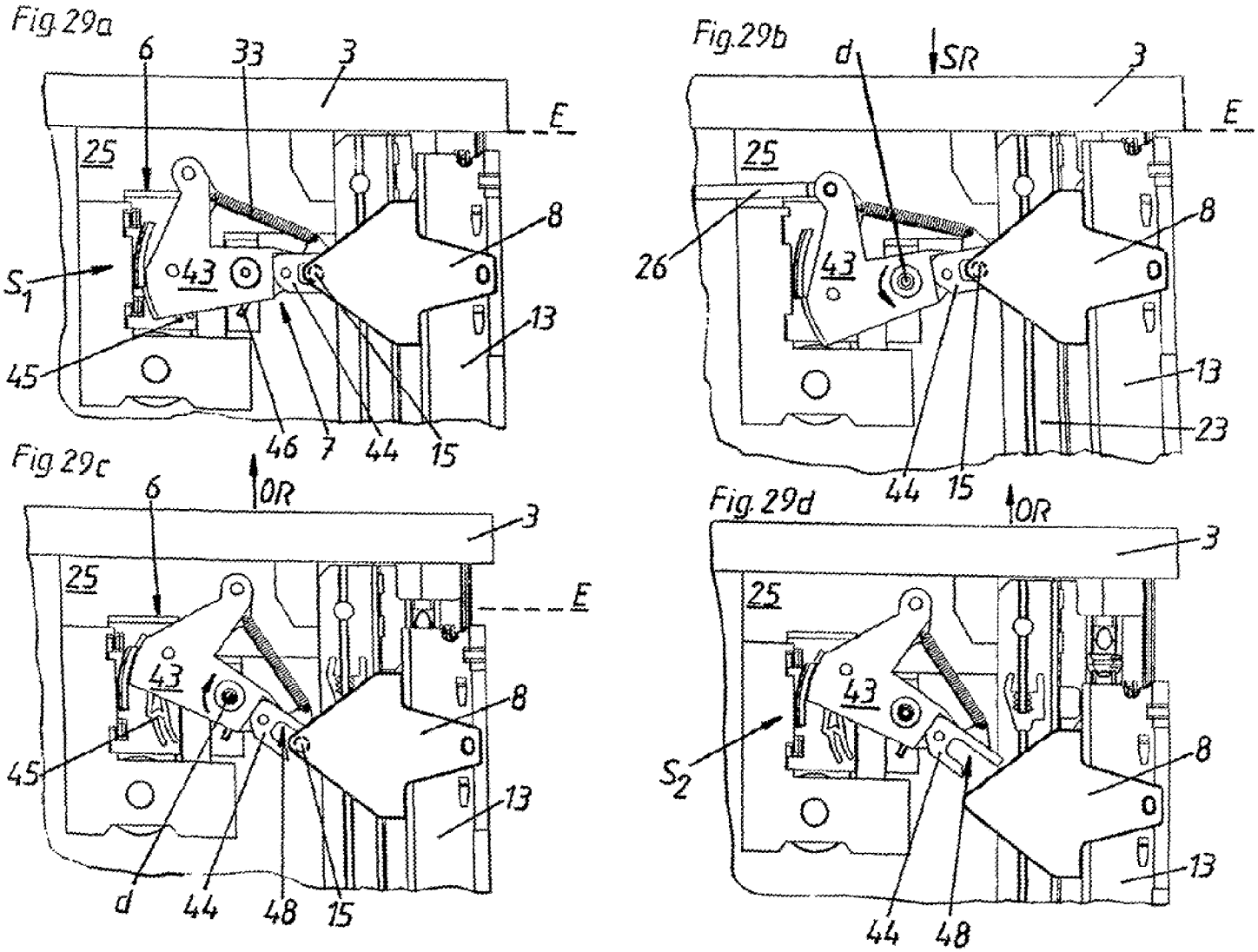

Starting from FIG. 29*a* in which the movable furniture part 2 is in its closed end position E and is held therein by the locking unit 6, wherein the locking element 44 of the receiving element 7 arrests the pin 15 of the engagement element 8 and the base element 43 of the receiving element 7 is fixed by means of the blocking mechanism 31, the user exerts a force on the front panel 3 in the closing direction SR of the movable furniture part 2 until the movable furniture part 2 has reached the triggering position shown in FIG. 29*b*.

The movement of the movable furniture part 2 into the release position provides that the blocking mechanism 31 formed by a sliding guide track 45 is released whereby the base element 43 is pivoted so that the pin 15 of the engagement element 8 is released by the locking element 44 (FIG. 29*c*) and the movable furniture part 2 is displaced by means of the ejector device into an open position as shown in FIG. 29*c*.

FIGS. 30*a* through 30*g* show different positions of the receiving element 7 of the locking unit 6 of the embodiment of FIG. 20*a* in the case of incorrect operation by a user. In that respect incorrect operation is used to mean that the user pulls the movable furniture part 2 out of the furniture carcass 4 without previously releasing the locking action in respect of the engagement element 8 by the receiving element 7 by pushing in the movable furniture part 2.

Figures 30A, 30B, 30C, 30D:
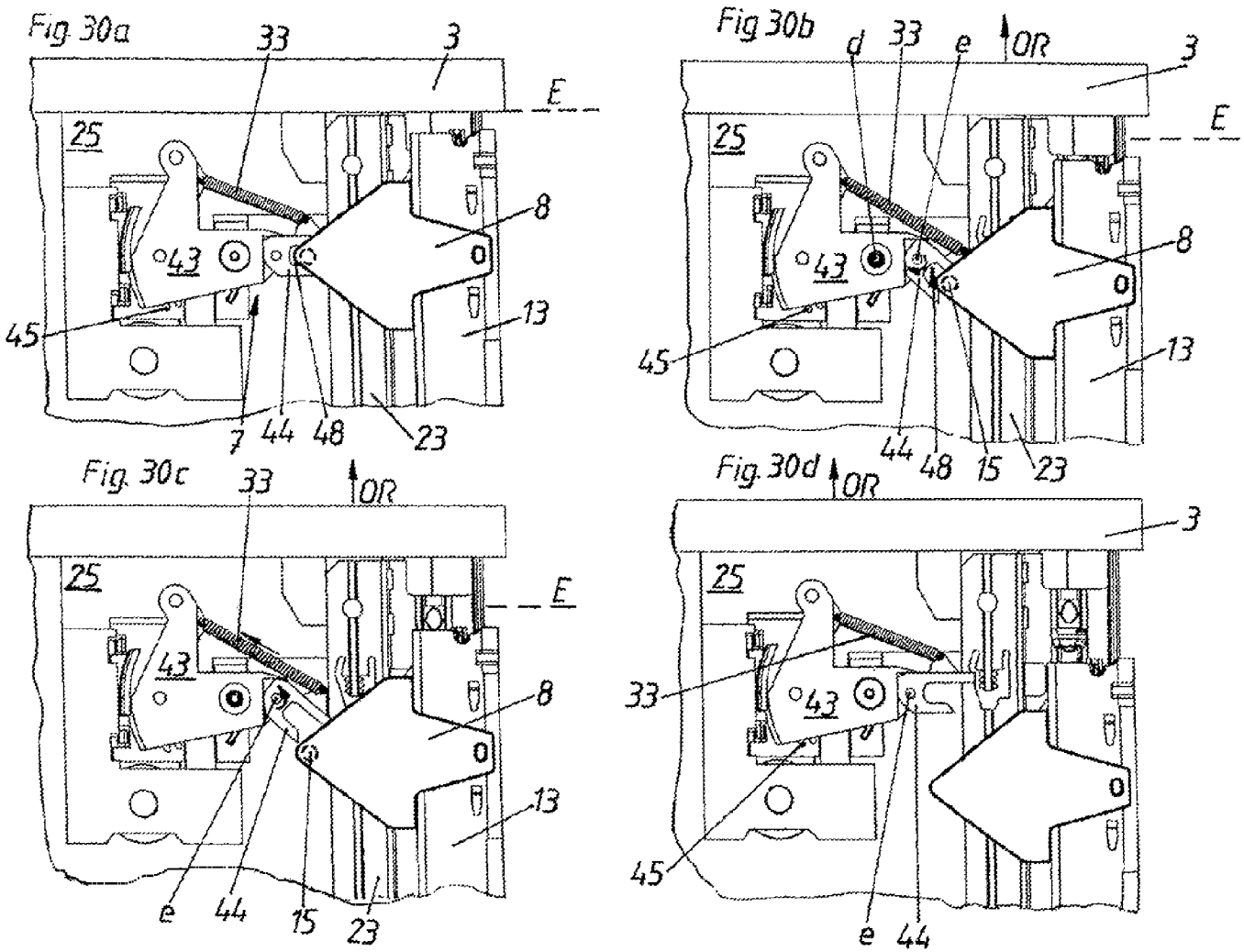
FIGS. 30*a* through 30*g* show different positions of the receiving element of the locking unit after improper operation by a user.

In this respect FIG. 30*a* again shows the starting position in which the movable furniture part 2 is in its closed end position E. If now as shown in FIG. 30*b* the movable furniture part 2 is pulled directly in the opening direction OR the locking element 44 of the receiving element 7, by virtue of its contact with the pin 15 of the locking element 8, is rotated or pivoted about the axis of rotation e, more specifically against the force of the holding device 33 which in this embodiment is formed by a tension spring.

In FIG. 30*c* the pin 15 of the engagement element 8 has already left the receiving region 48 of the locking element 44, whereby the locking element 44 is pivoted back again by means of the holding device 33, that is to say the tension spring as it is relieved of stress (FIG. 30*d*). In that position therefore the movable furniture part 2 is disposed in an open position, with the blocking mechanism 31 for the base element 43 not being released.

Figure 30F:
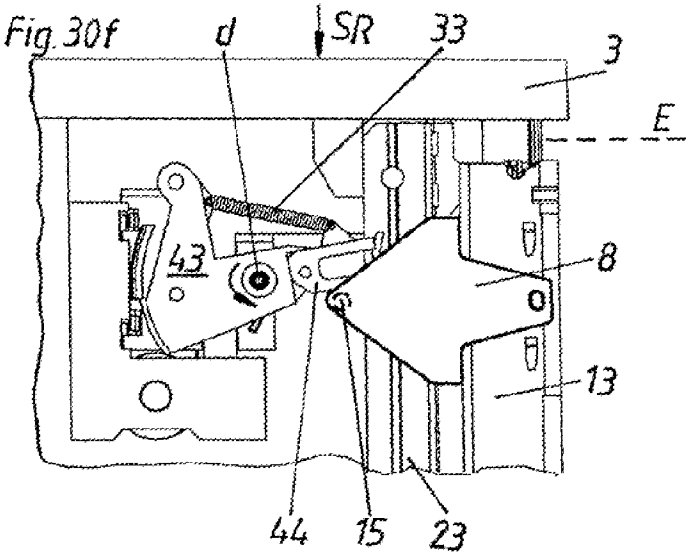
Figure 30E:
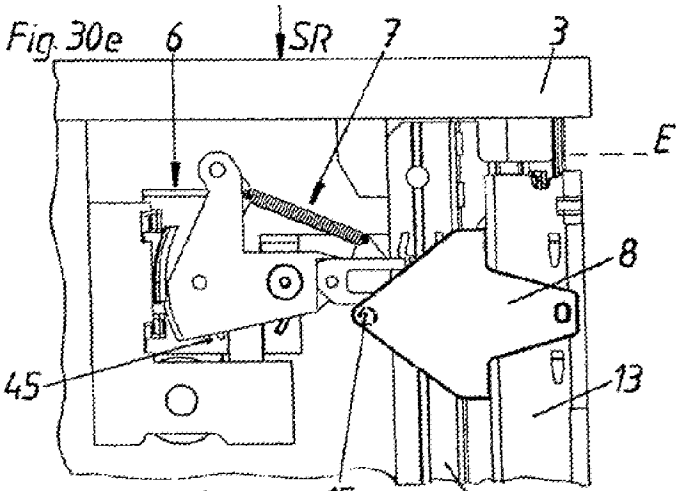

If now as shown in FIG. 30*e* the movable furniture part 2 is moved in the closing direction SR into the furniture carcass 4 the locking element 44 moves onto the pin 15 and, in a further inward movement of the movable furniture part 2, the receiving element 7 is pivoted as shown in FIG. 30*f* whereby the blocking mechanism 31 is released and the base element 43 is pivoted by virtue of the spring 46 being relieved of stress, into a position of releasing the pin 15, whereby the movable furniture part 2 is once again displaced into an open position (FIG. 30*g*) by the ejector device 18, the force storage means 19 of which was at least partially loaded by the inward movement of the movable furniture part 2.

Figure 30G:
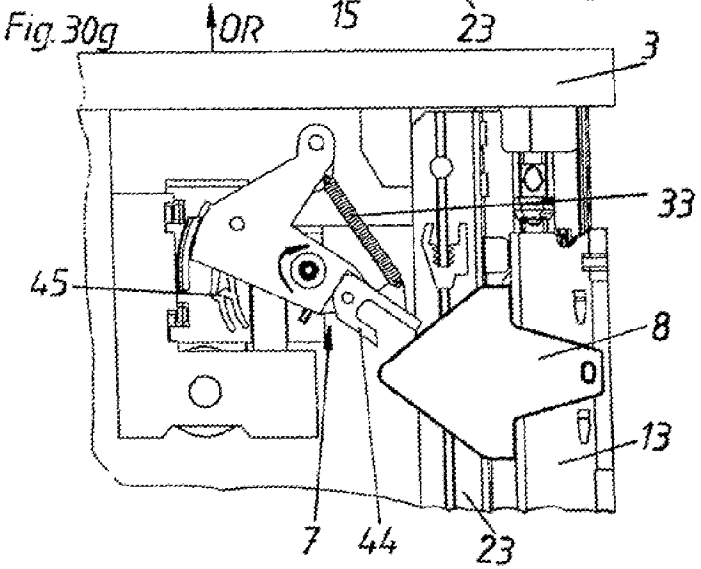

The open position in FIG. 30*g* after incorrect operation by the user therefore corresponds to the open position of FIG. 29*d* after a normal opening process. That means in other words that, in the event of incorrect operation by the user, in a first step the overload safety mechanism 32 comes into effect whereby the movable furniture part 2—although the locking unit 6 has not been unlocked—can be opened without parts of the locking unit 6, in particular the receiving element 7, being damaged before in a second step the movable furniture part 2 is moved in the closing direction SR again into the furniture carcass 4. When then the receiving element 7 bears against the pin 15 of the engagement element 8 the blocking mechanism 31 acting on the locking unit 6 is released in a third step whereby in a fourth step the movable furniture part 2 is again guided into an open position by virtue of the spring-loaded receiving element 7. In other words after incorrect operation by the user the movable furniture part 2 must be closed twice so that it is again in a closed end position E.

It will be appreciated that the illustrated embodiments of immobilization devices for arresting a movable furniture part and lockable ejector devices for a movable furniture part are not to be interpreted in a restrictive sense but in fact are only individual examples of numerous possible ways of implementing the concept of the invention of an immobilization device or a lockable ejector device for a movable furniture part.

The invention claimed is:

1. A lockable ejector device for a furniture part movably supported in an article of furniture, the lockable ejector device comprising:

a synchronization mechanism which has at least two coupling elements and at least one synchronization unit;

an immobilization device for arresting the movable furniture part in a closed end position; and at least one ejector element for moving the movable furniture part out of the closed end position into an open position, wherein the immobilization device has at least two locking units which are coupled together and each have a respective receiving element for a respective engagement element, wherein the receiving elements of the at least two locking units are operatively connected together by way of the synchronization mechanism, the at least two coupling elements of the synchronization mechanism being respectively associated with the at least two locking units, wherein the coupling elements are movably coupled together by the synchronization unit in a position arresting the engagement elements and in a position releasing the engagement elements, and wherein each locking unit has a blocking mechanism for releasably fixing the receiving element in the position of arresting the respective engagement element, and the blocking mechanism is separate and independent from the engagement element.

2. The lockable ejector device of claim 1, wherein the at least two coupling elements are movably coupled by the synchronization unit to move in opposite directions.

3. The lockable ejector device of claim 1, wherein the synchronization unit has a stationarily arranged base element on which a synchronization element is rotatably movably supported.

4. The lockable ejector device of claim 3, wherein the base element is at least of a two-part structure and has a main element and an intermediate element, wherein the synchronization element is rotatably supported on the intermediate element.

5. The lockable ejector device of claim 3, wherein the synchronization element is formed by a gear.

6. The lockable ejector device of claim 5, wherein the synchronization unit has two racks which are mounted movably with a translational motion on the base element, and the two racks are in engagement on opposite sides with the synchronization element and are or can be respectively connected to end portions of the coupling elements.

7. The lockable ejector device of claim 3, wherein the synchronization element is formed by a double-armed lever which is or can be connected in its two end portions to a respective coupling element.

8. The lockable ejector device of claim 1, wherein the at least two coupling elements are adapted to transmit or exert pulling and/or pressing forces.

9. The lockable ejector device of claim 8, wherein the coupling elements are of a flexurally stiff and/or torsionally stiff configuration.

10. The lockable ejector device of claim 8, wherein the coupling elements are of a bar-shaped or tube-shaped configuration.

11. The lockable ejector device of claim 1, wherein each of the locking units includes a displacement device which linearly adjusts the position of the receiving elements relative to the respective engagement element in a direction of the depth of the article of furniture, wherein the displacement device converts a rotary movement into a translational movement.

12. The lockable ejector device of claim 1, further comprising a displacement device which linearly adjusts the position of each of the receiving elements relative to the respective engagement element in a direction of the depth of the article of furniture, wherein the displacement device converts a rotary movement into a translational movement, wherein at least one of the locking units includes a base portion and a slide portion which is supported linearly movably with respect to the base portion, and the receiving element is arranged on the slide portion, and wherein the displacement device acts on the slide portion.

13. The lockable ejector device of claim 1, wherein each locking unit includes a base portion, and the receiving element of each locking unit is rotatable relative to the base portion.

14. The lockable ejector device of claim 13, wherein locking of the ejector device is effected by the blocking mechanism for the receiving element.

15. The lockable ejector device of claim 13, wherein at least one of the locking units has an overload safety mechanism which includes at least two parts which are movably connected together and which allows damage-free opening of the movable furniture part even when the receiving element is fixed by the blocking mechanism in a position of arresting the engagement element.

16. The lockable ejector device of claim 15, further comprising a holding device, wherein the two parts of the overload safety mechanism are rotatably connected to each other and are pivotable between a first end position and a second end position and between which the holding device is operable for releasably holding or for returning the two parts to the first end position.

17. The lockable ejector device of claim 13, wherein the receiving element has a base element and a locking element movably connected to the base element, wherein the blocking mechanism acts on the base element.

18. The lockable ejector device of claim 15, wherein the receiving element has a base element and a locking element movably connected to the base element, wherein the blocking mechanism acts on the base element, and wherein the at least two parts of the overload safety mechanism, that are movably connected together, are formed by the base element and the locking element of the receiving element.

19. The lockable ejector device of claim 1, wherein each locking unit includes a blocking mechanism, an overload safety mechanism and a displacement device.

20. The lockable ejector device of claim 1, wherein the ejector element is arranged on one of the locking units.

21. The lockable ejector device of claim 1, wherein the ejector element is arranged separately from the immobilization device on the movable furniture part or on the article of furniture.

22. The lockable ejector device of claim 21, wherein the ejector device or the ejector element is arranged in the guide system for a drawer forming the movable furniture part.

23. An article of furniture comprising the lockable ejector device of claim 1 and the movable furniture part.

24. The article of furniture of claim 23, wherein the immobilization device and the synchronization mechanism are arranged at the underside of the movable furniture part.

25. The article of furniture of claim 23, wherein the immobilization device and the synchronization mechanism are arranged on the movable furniture part and the engagement elements are stationarily arranged on the article of furniture.

26. The article of furniture of claim 23, further comprising a displacement device which linearly adjusts the position of each of the receiving elements relative to the respective engagement element in a direction of the depth of the article of furniture, wherein the blocking mechanism of each locking unit is connected to the movable furniture part, and the displacement device is configured such that adjustment of the receiving element moves the blocking mechanism relative to the movable furniture part.

27. The lockable ejector device of claim 1, further comprising a displacement device which linearly adjusts the position of each of the receiving elements relative to the respective engagement element in a direction of the depth of the article of furniture, wherein the displacement device converts a rotary movement into a translational movement.

* * * * *